US008319590B2

(12) United States Patent
Magnier

(10) Patent No.: US 8,319,590 B2
(45) Date of Patent: Nov. 27, 2012

(54) DEVICE FOR EXPLOSION PREVENTION OF AN ON LOAD TAP CHANGER INCLUDING A RUPTURE ELEMENT

(75) Inventor: Philippe Magnier, Houston, TX (US)

(73) Assignee: Philippe Magnier LLC, Humble, TX (US)

( * ) Notice: Subject to any disclaimer, the term of this patent is extended or adjusted under 35 U.S.C. 154(b) by 47 days.

(21) Appl. No.: 13/052,899

(22) Filed: Mar. 21, 2011

(65) Prior Publication Data

US 2012/0242443 A1 Sep. 27, 2012

(51) Int. Cl.
*H01F 27/02* (2006.01)

(52) U.S. Cl. ..... 336/90

(58) Field of Classification Search ..... 336/55–62, 336/65, 90, 92; 361/35–38
See application file for complete search history.

(56) References Cited

U.S. PATENT DOCUMENTS

| | | | | |
|---|---|---|---|---|
| 5,946,171 | A * | 8/1999 | Magnier | 361/37 |
| 6,804,092 | B1 * | 10/2004 | Magnier | 361/38 |
| 7,777,994 | B2 * | 8/2010 | Magnier | 361/37 |
| 2008/0100972 | A1 * | 5/2008 | Magnier | 361/37 |

* cited by examiner

*Primary Examiner* — Tuyen Nguyen
(74) *Attorney, Agent, or Firm* — Meyertons, Hood, Kivlin, Kowert & Goetzel, P.C.; Eric B. Meyertons

(57) ABSTRACT

Device for prevention against explosion of an on load tap changer on an electrical transformer, the on load tap changer including a tank and a cover, the tank including a cooling liquid. The prevention device includes a rupture element provided with tearing zones and with folding zones upon rupture, said rupture element being able to break open when the pressure inside the tank exceeds a predetermined ceiling, at least a support member supporting the rupture element, said support member supporting a duct downstream the rupture element, the support element being distinct from the cover.

17 Claims, 4 Drawing Sheets

Fig.1
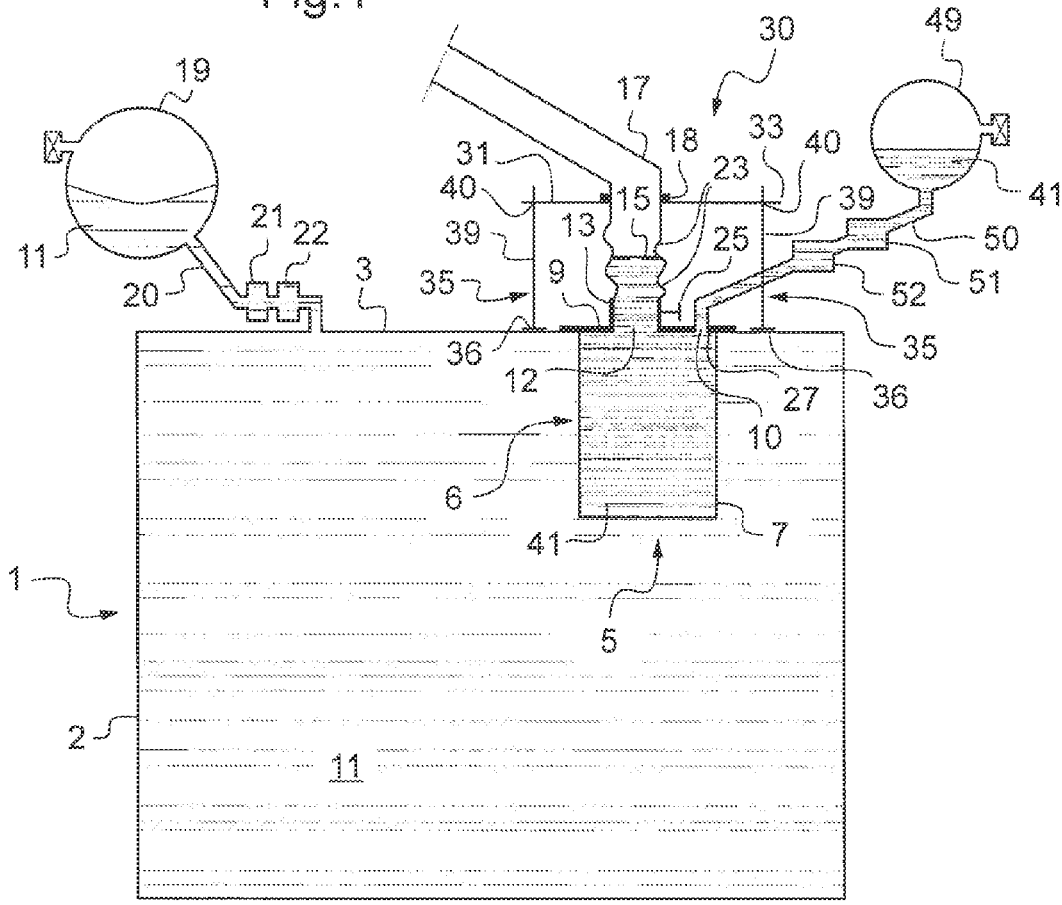
Fig.8
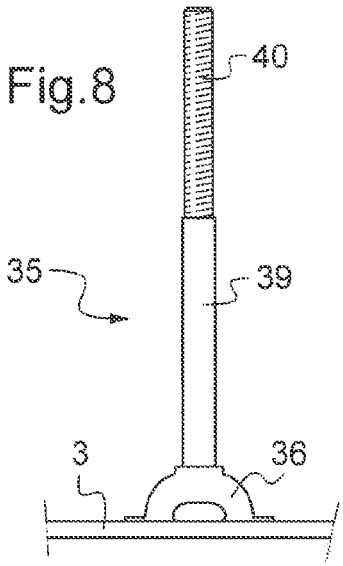
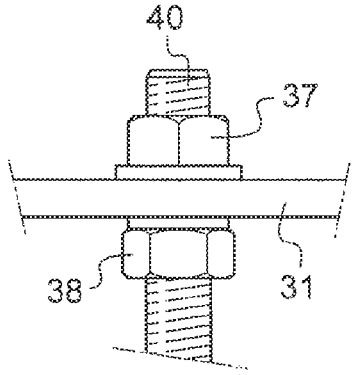
Fig.9

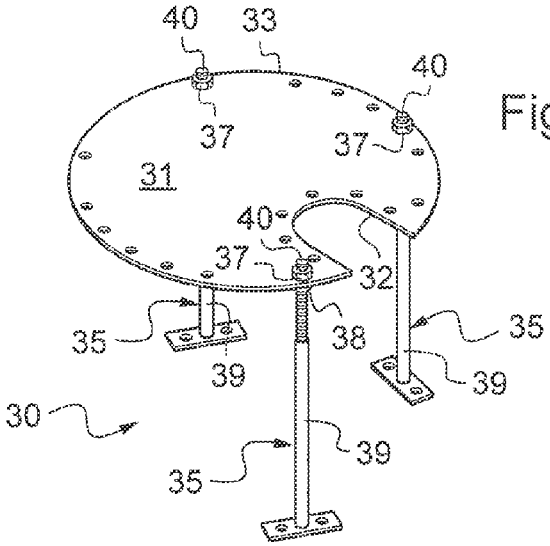
Fig.2
Fig.3
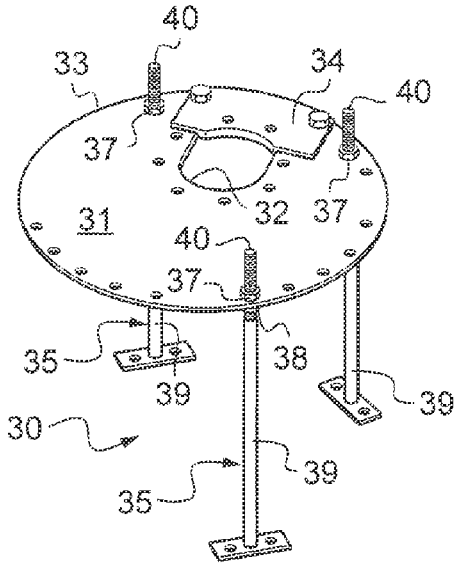
Fig.4
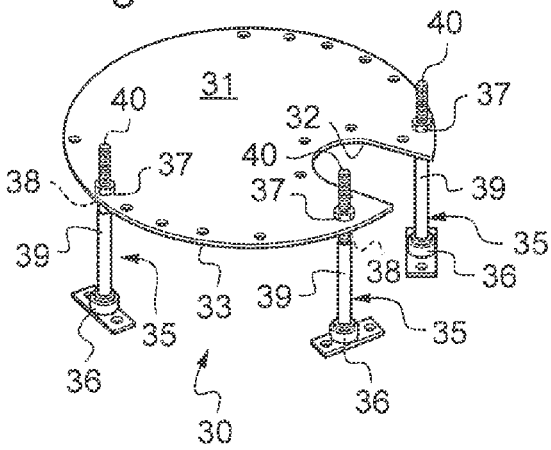
Fig.5
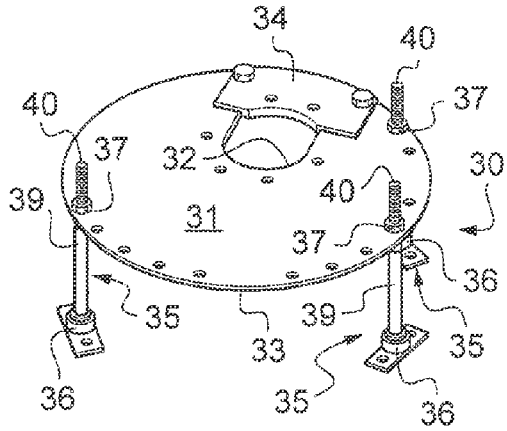

DEVICE FOR EXPLOSION PREVENTION OF AN ON LOAD TAP CHANGER INCLUDING A RUPTURE ELEMENT

BACKGROUND OF THE INVENTION

1. Field of the Invention

The present invention relates to the field of the prevention against explosion of on load tap changers of electrical transformers.

2. Description of the Relevant Art

Due to their structure, on load tap changers (OLTC) exhibits small electrical arcs during commutations from one step to an other. The OLTC are generally at least in part filled by a dielectric fluid such as oil. The oil used can ignite above a temperature of the order of 140° C. The electrical arcs increase the oil degradation inside the OLTC. The OLTC exhibit losses, for which reason the heat produced needs to be dissipated. This heat dissipation is also made by the oil.

An electrical insulation fault, between phases or between one phase and the ground, firstly generates a strong electric arc which causes actuation of the electrical protection systems which triggers the supply cell of the transformer (circuit breaker). The electric arc also causes resultant dissipation of energy, which causes a gas production, specially hydrogen and acetylene, by dielectric oil decomposition.

After the gas discharge, the pressure inside the OLTC tank increases very rapidly, leading to an often very violent deflagration. The deflagration causes significant tearing of the mechanical linkages of the tank (bolts, welds) placing the gases in contact with the oxygen in ambient air. Since acetylene self-ignites in the presence of oxygen, a fire breaks out immediately and spreads to other items of equipments on the site which are also likely to contain large quantity of combustible substances.

Explosions are caused by insulation ruptures due to short-circuits caused by overloads, voltage surges, gradual deterioration of the insulation, insufficient oil level, the presence of water or mold or failure of an insulation component.

In the prior art, fire extinguishing systems for electric transformers were activated by fire detectors. However these systems operated with a significant lag, when the transformer oil was already burning. The fire outbreak is merely restricted to the equipment concerned to not spreading the fire to the neighboring installations.

A prevention device against explosion and fires of electrical transformers and on load tap changers is known since the late 90's.

The invention improves the situation.

SUMMARY OF THE INVENTION

The prevention device against explosion of an on load tap changer of electrical transformer includes a tank and a cover. The tank contains dielectric liquid. The prevention device includes a rupture element. The rupture element tightly closes the tank. The rupture element includes tearing zones and folding zones upon rupture. The rupture element is able to break open when the tank internal pressure exceeds a predetermined threshold. The device includes at least one support member of the rupture element. The support member supports a duct downstream the rupture element. The support component is distant from the cover.

The support member is able to support a duct upstream the rupture element and being in communication with the tank. The load supported by the cover of the on load tap changer is reduced.

A flexible sleeve can be mounted between the rupture element and the downstream duct. The rupture element and the on load tap changer are at least partially mechanically isolated from the disposal pipes downstream.

A flexible sleeve can be mounted between a rupture element and a duct downstream from the rupture element and being in communication with the tank. The rupture element and the on load tap changer are at least partially mechanically mutually isolated. Vibration of transformer and on load tap changer in service may be absorbed by the flexible sleeve.

The support member can include a plate. The plate can be provided with a notch whereby a downstream duct passing through. The plate takes part in load reparation of the prevention device. The plate could be led out to be adapted to many configurations of existent transformers.

The plate could include a periphery generally shaped in a circle to be adjustable to many configurations and to restrict stress concentrations.

The device could include a flange fixed to the plate and maintaining the downstream duct into the notch. The flange improves the position of the downstream duct in respect to the supports member and precisely into the notch.

The downstream duct could include a flange to fix the support member. The flange is used as a buffer between the downstream duct on the support member. The flange absorbs at least partially friction and/or vibration during service.

The support member could include a plurality of legs. The plate is supported by legs. The supporting of plate by legs is adjustable. These make it possible to adapt position of support member with many configurations of transformers.

At least one leg could be associated with a dilatation compensator. The element of the prevention device could be composed with many materials, so dilatation ratios are different. The dilatation compensators are able to absorb relative displacements of many elements of the device.

At least one leg could have a setting length. It is possible to adapt the plate orientation and the support member orientation as a function of configurations of transformers, on load tap changer, and prevention devices.

The dilatation compensators could have a damping function. The device could have thermal dilatations and mechanical vibrations. It is economic to have pieces absorbing both phenomena.

The dilatation compensator includes metal. The fire risk is reduced.

The dilation compensator could include steel wool. The dilation compensation is ensured by structure or design instead of the material. Fire properties of these materials are good.

The device could include an isolation valve disposed downstream from the rupture element. The inside of the on load tap changer could be isolated during maintenance operations on rupture element or other elements downstream the rupture element.

The on load tap changer could include a head supporting the cover. The head could be fixed to a wall of the transformer by nuts. At least one of the said nuts could fix the support member too. At least one of the said nuts could fix the dilatation compensator too.

The on load tap changer tank could be distal from the main tank of the transformer. The risk of reaction in chain in case of fire is reduced.

BRIEF DESCRIPTION OF THE DRAWINGS

The invention will be understood more clearly on studying the detailed description of a particular embodiment, taken as an entirely non-limiting example, and illustrated by the appended drawings, in which:

FIG. 1 is a schematic view of a transformer provided with a prevention device and a support member;

FIG. 2 is a view in perspective of the support member;

FIG. 3 is a view in perspective of the support member;

FIG. 4 is a view in perspective of the support member;

FIG. 5 is a view in perspective of the support member;

FIG. 8 is a schematic view of a leg with a dilatation compensator;

FIG. 9 is a schematic partial view of an adjustable fixing of a leg;

Figure 6:
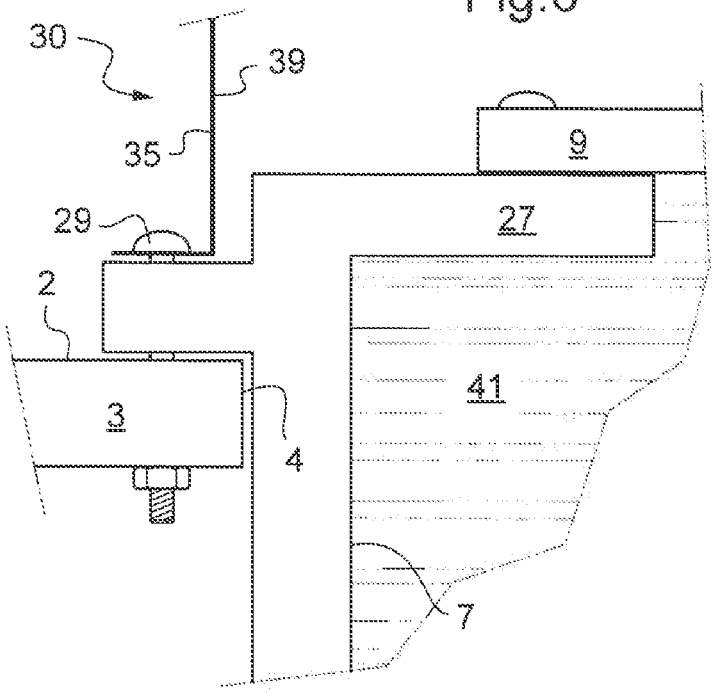
FIG. 6 is schematic partial view in detail of a prevention device provided with a support member.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

By words "normal" or "conventional operation" it should be understand here the energy conversion mode by the transformer. The words "upstream" and "downstream" has to be understood in a direction of displacement of the oil from the tank to the outside.

The prevention device of the on load tap changers of the prior art, involve installation of many massive elements near the on load tap changer, and precisely near the cover of the on load tap changer. The on load tap changer cover having to support the weight of prevention device elements, has to be designed to mechanically resist to the supplementary weight. A posterior installation of a prevention device on an existing electrical transformer involves substituting the cover of the on load tap changer by a new cover well adapted. The on load tap changer cover replacement increases cost. The replacement of a cover by a new cover could involve new validations relatives to safety standards. During maintenance operations, if the cover of the on load tap changer has to be open, the prevention device disassembly may lost a long time.

During his searches, the Applicant observed that transformer tank walls are generally stiffer than the cover of the on load tap changer. The transformer main tank is generally widely above robustness required to support the supplementary mass of the protection device. The applicant tried to delocalize the support surfaces of the prevention device from on load tap changer explosion, to transformers tank walls. To share loads of the prevention device weight, on the transformer tank walls, spares the cover of the on load tap changer, of a supplementary weight. The same cover of the on load tap changer remains during the prevention device installation on a pre-existing on load tap changer. The cover of the on load tap changer could be designed to seal the on load tap changer tank.

The electrical transformer 1 includes a main tank 2 and at least one upper wall 3, cf. FIG. 1. The upper wall 3 could have a form of a cover covering the main tank 2. The upper wall 3 could include steel. The main tank 2 of the transformer 1 is fluidly connected to a conservator 19. The conservator 19 is disposed at an altitude higher than the altitude of the main tank 2 of the transformer 1. The main tank 2 of the transformer 1 is filled with a dielectric liquid 11. The conservator 19 is at least partially filled with a dielectric liquid 11. A conduct 20 lets in fluidic communication the conservator 19 and the main tank 2. The dielectric liquid 11 level in the main tank 2 is preserved substantially constant thanks to the fluidic communication with the conservator 19. The dielectric liquid 11 volume could vary because of thermal dilation (containers and contents). The conservator 19 houses the dielectric liquid 11 level fluctuations instead of the main tank 2. The conservator 19 makes it possible to correct the volume variations of dielectric liquid 11 due to the dilatation.

The transformer 1 is provided with one or more on load tap changers 5 (OLTC). An on load tap changer 5 serves as interface between the transformer 1 and the electrical power greed to which it is connected in order to provide a constant voltage despite variations in the power exchanged with the grid. The on load tap changer 5, here, is located in the main tank 2 of the transformer 1. The on load tap changer 5, inserted from the upper wall 3, could bath in the dielectric liquid 11 contained in the main tank 2 of the transformer 1.

The on load tap changer 5 includes its own tank 7. The tank 7 is at least partially filled by a dielectric liquid 41. The main property of the dielectric liquid 41 is to be insulating. In fact, the on load tap changer 5 sustains electrical arcs regularly but sustains moderate heat increasing.

Nevertheless, the on load tap changer 5 is cooled by the combustible dielectric liquid 41 which can be the same of the dielectric liquid 11 contained in the main tank 2 of the transformer 1. Due to the high mechanical resistance of the on load tap changer, its explosion is often very violent and there is jets of burning dielectric liquid 41. The tank 7 of the on load tap changer 5 is fluidly connected to a conservator 49. The conservator 49 is at least partially filled with the burning dielectric liquid 41. The fluidic connection between the conservator 49 and the tank 7 of the on load tap changer 5 is ensured by a conduit 50. The conservator 49 is disposed at an altitude higher than the on load tap changer 5 altitude. The dielectric liquid 41 level in the tank 7 is preserved substantially constant thanks to the fluidic communication with the conservator 49. The dielectric liquid 41 is subject to volume fluctuations due to thermal dilatation phenomena (container and content). The conservator 49 houses dielectric liquid level variations instead of the tank 7. The conservator 49 makes it possible to adjust dielectric liquid 41 variations due to dilatation.

The conduit 50 can be equipped with an automatic valve 51 to close the conduit 50 in case of significant movements of the dielectric liquid 41. At the time of a depressurization of the tank 7 of the on load tap changer 5, a beginning of a dielectric liquid 41 flow appends and is stopped by the closure of the automatic valve 51. The drainage of the dielectric liquid 41 contained in the conservator 49 is avoided. A Buchholz 52 could be mounted in the conduit 50 between the automatic valve 51 and the tank 7. In service or during tank filling of the on load tap changer 5, the automatic valve 51 is open. The automatic valve 51 is autonomous. The automatic valve 51 has a mechanical working. The automatic valve 51 can be linked to sensors. The automatic valve 51 can be locked in open position during the filling of the tank 7. This valve is sold by Sergi since the 60's.

The conduit 20, linking the conservator 19 and the main tank 2, could be provided with an automatic valve 21 and/or a Buchholz 22 in the same way as described previously.

The conservators 19 and 49, the conduits 20 and 50, the automatic valves 21 and 51 and the Buchholz 22 and 52 are distinct from the main tank 2 in a part and from the tank 7 of the on load tap changer 5 for the other part, in accordance with the embodiment shown on FIG. 1.

In other embodiments and combinations, conservators 19 and 49, conduits portions 20 and 50, automatic valves 21 and 51 and/or the Buchholz 22 and 52 could be at least partially common for the main tank 2 and for the tank 7 of the on load tap changer 5.

The tank 7 of the on load tap changer 5 includes an upper part or head 27, as shown on FIGS. 1 and 6. The head 27 is ring shaped. The head 27 has, here, a thickness between 15 and 25 millimeters. The head 27 is closed by a cover 9. The cover 9 could include aluminum and/or aluminum alloy. The cover 9 has, here, a thickness between 8 and 20 millimeters. The conduit 50 opens in the tank 7 of the on load tap changer 5 with a first orifice 10 arranged in the cover 9 of the on load tap changer 5. The head 27 of the on load tap changer 5 could be fixed to the upper wall 3 of the main tank 2 of the transformer 1. The head 27 of the on load tap changer 5 geometrically shaped to fit on an aperture 4 disposed in the upper wall 3 of the main tank 2 of the transformer 1. The head 27 could be supported by the upper wall 3. The head 27 of the on load tap changer 5 is tightly fixed to the upper wall 3 of the transformer 1. In another embodiment, shown on FIG. 7, the head 27 of the on load tap changer 5 could be fixed on the upper wall 32 of the transformer 1 by nuts 29.

The head 27 of the on load tap changer 5 protrudes above the upper wall 3 of the transformer 1. The tank 7 of the on load tap changer 5 is disposed in the aperture 4 arranged in the upper wall 3. The cover 9 is mounted above the upper wall of the transformer 1. An upper part of the on load tap changer 5 is in posed to ambient air. The on load tap changer 5 includes main mechanisms mounted in the tank 7.

The prevention device includes an upstream duct 13, cf. FIG. 1. The prevention device includes an isolation valve 25. The prevention device includes a first flexible sleeve 23. The prevention device includes a rupture element 15. The prevention device includes a second flexible sleeve 23. The prevention device includes a downstream duct 17. The prevention device could include the said elements in this order from the tank 7 to the outside, in other words, from upstream to downstream.

A chamber 6 of the on load tap changer 5 is delimited by the tank 7 and the cover 9. The chamber 6 is open in the upstream duct 13 passing through a second orifice 12 in the cover 9. The upstream duct 13 is mounted above the cover 9 and in tightly communication with the said second orifice 12. The upstream duct 13 is downstream the tank 7 of the on load tap changer 5. The upstream duct 13 is, here, substantially vertical. The upstream duct 13 could be provided with the isolation valve 25. During normal service of the on load tap changer 5, the isolation valve 25 is open. The isolation valve 25 could be closed during maintenance operations, especially during intervention downstream the upstream duct 13. The isolation valve 25 makes it possible to isolate elements downstream the said isolation valve 25.

Downstream and in the continuation of the upstream duct 13, the first flexible sleeve 23 is disposed. The first flexible sleeve 23 is disposed upstream the rupture element 15. The first flexible sleeve 23 is generally shaped as a pleated section, for example wrinkled. The first flexible sleeve 23 is made of a tight material and structure. The first flexible sleeve 23 is configured to ensure fluidic isolation with outside, between the upstream duct 13 disposed upstream and the rupture element 15 disposed downstream. The first flexible sleeve 23 can undergo significant elastic strain. The first flexible sleeve 23 is configured to reduce vibrations between the upstream duct 13 disposed upstream and the rupture element 15 disposed downstream. The first flexible sleeve 23 can include materials chemically resistant to the dielectric liquid 41 and have anti-fire properties, for example, Polytetrafluoroethylene (PTFE).

In normal service, the upstream duct 13 and the first flexible sleeve 23, in communication with the inside of the tank 7, are filled by dielectric liquid 41 until the rupture element 15. In function of manufacturing requirements, of available volume and of mounting easiness, the upstream duct 13 and the first flexible sleeve 23 are laid out to be as short as possible.

The rupture element 15 is located downstream the first flexible sleeve 23. In normal service, the rupture element 15 closes downstream end of the first flexible sleeve 23. The rupture element 15, in normal service of the transformer 1, which mean when the rupture element 15 is intact, participates to the fluidic isolation between the inside and the outside of the on load tap changer 5. The rupture element 15 is able to tear in case of over pressure inside the tank 7 of the on load tap changer 5, for example due to electrical insulation break. The explosion of the tank 7 of the said on load tap changer 5 is avoided. The rupture element 15 provides good resistance to the pressure in one direction (here, from downstream to upstream), a calibrated resistance to the pressure in the other direction (here, from upstream to downstream), excellent impermeability and low lag of bursting. The rupture element 15 as to be understood as a quick rupture element 15 because the delay between the occurrence of the over pressure in the tank 7 and the rupture element 15 is about few milliseconds and directly linked to the propagation speed of waves in the dielectric liquid 41. The rupture element 15 could be that described in WO 00/57438.

The second flexible sleeve 23 is disposed downstream the rupture element 15. The second flexible sleeve 23 is disposed upstream the downstream duct 17. The second flexible sleeve 23 is similar to the first flexible sleeve 23. The second flexible sleeve 23 is laid out to ensure fluidic isolation between outside and the continuation of the rupture element 15 arranged upstream and the downstream duct 17. The second flexible sleeve 23 is laid out to absorb, at least partially, vibrations between the rupture element 15 disposed upstream and the downstream duct 17.

The downstream duct 17 is disposed in continuity and downstream the second flexible sleeve 23. The downstream duct 17 leads a potential flow of dielectric liquid 41 to an appropriate place, for example a collection reservoir or a pit. Here, the downstream duct 17 includes a first vertical section in line with the upstream duct 13, a bend, following by a second section with a notch connecting to a collection reservoir, as described in U.S. Pat. No. 7,317,598 incorporated herein.

The prevention device includes, a flange 18. The flange 18 is, here, mounted around the downstream duct 17. The flange 18 encloses at least partially the outside of a section of the downstream duct 17. The flange 18 is used as base for a support member 30. The flange 18 is connected to the support member 30. The support member 30 is in contact with the flange 18. The flange 18 could include galvanized steel or stainless steel.

The support member 30 is pressed on the upper wall 3 of the main tank 2 of the transformer 1. The support member 30 mechanically carries the downstream duct 17 disposed downstream the rupture element 15. The support member 30 is carried by the upper wall 3 of the main tank 2 of the transformer 1 at distance from the cover 9 of the on load tap changer 5. The support member 30 includes a plate 31. The support member 30 includes several legs 35, here, three legs 35. The support member 30 could include steel.

The plate 31 of the support member 30 could be disk shaped. The plate 31 includes a periphery generally in circle. The plate 31 includes a notch 32, cf. FIGS. 2 to 5. The notch 32 forms a cutout in the plate 31 from its periphery 33. The notch 32 houses at least partially the downstream duct 17. In a mounted state, the plate 31 mechanically carries the downstream duct 17 via the downstream duct 32 and the flange 18. The plate 31 could include steel, for example stainless steel 304.

Each leg 35 includes a rod 39. The rod 39 includes an upper threaded part 40, cf. FIG. 9. The leg 35 is fixed to the plate 31 via the upper threaded part 40. The leg 35 could be fixed to the plate 31 by fixation means. For example, a fixation means could include an upper nut 37 and a lower nut 38. The threaded upper part 40 is mounted in a hole provided through the plate 31. The threaded upper part 40 supports, from the down to the top, the lower nut 38 which supports the plate 31, the plate 31 and the upper nut 37 which blocks the plate 31 with respect to the leg 35.

Here, the three legs 35 form vertex for triangle of support of the plate 31. The number and arrangement of legs 35 in respect of the plate 31 are chosen, cf. FIGS. 2 to 5. The choice of the number and the disposition of legs 35 with respect to the plate 31 depends of the mass repartition to support and the available surface. The legs 35 could be disposed mutually in equidistance near the periphery 33 of the plate 31. As shown on figures, legs 35 are fixed near the periphery 33 of the plate 31 in such a manner that the barycentre of the said support triangle of the plate 31 is off centered in direction of the notch 32. The number and the distribution of legs 35 are an optimum of an ideal mass repartition and an available space on the upper wall 3 for other systems. The plate 31 could be provided with a number of holes greater than the number of legs 35. The plate 31 could be standardized. The plate 31 could be provided with a number or a distribution of legs 35 at the moment of the mounting on the transformer 1, in accordance with a configuration adapted with the transformer 1. The number or the distribution of legs 35 could especially depend of possible tubes or components passing through the upper wall 3. The legs 35 could include steel, for example stainless steel 316.

In a mounted state, cf. FIG. 1, the downstream duct 17 is fixed to the plate 31 of the support member 30 via the notch 32 and the flange 18. In an embodiment, cf. FIGS. 3 and 5, a strap 34 detachable is laid out to close the notch 32, for example after placing the downstream duct 17 in the said notch 32. The strap 34 could be fixed by screws and nuts, to the plate 31 of the support member 30 provided with matching holes. The downstream duct 17 is mechanically blocked in vertical translation relative to the plate 31 and the possible strap 34. In other words, the weight of the downstream duct 17 and the weight of elements directly fixed to the downstream duct 17 are at least partially transmitted to the plate 31 and/or to the strap 34. The downstream duct 17 is mechanically blocked in horizontal translation relative to the plate 31 and the possible strap 34. The downstream duct 17, the flange 18, and the plate 31 of the support member 30 are secured together. Each fixation means, including here a bolt and at least one nut, could include an anti-loosening mean, for example an elastomeric ring. The value of clamping is generally sensitive to vibration and movements by thermal dilatation. The anti-loosening system improves the situation.

The fixation of at least one leg 35 to the plate 31 could be adjustable. The vertical positioning of the plate 31 is chosen by positioning the upper nut 37 and the lower nut 38 on the thread of the threaded upper part 40 of the legs 35. The plate 31 is placed between the upper nut 37 and the lower nut 38, cf. FIG. 9. The upper nut 37 and the lower nut 38 block vertically the plate 31 relative to the leg 35 adjustable. In a mounted state, the plate 31 is substantially horizontal. The plate 31 is substantially parallel to the upper wall 3 of the transformer 1. The adjusting of the support member 30, such a manner at the weight of the protection device is supported by the member support 30, could be adapted during mounting operation by adjusting the height of the at least one leg 35 adjustable.

A lower part of each leg 35 is based on the upper wall 3 of the main tank 2 of the transformer 1. The weight of the plate 31 and other elements based on the said plate 31, is transmitted to the upper wall 3, via the legs 35.

The lower part of legs 35 are in contact with the upper wall 3 of the transformer 1, cf. FIGS. 2 and 3. The lower parts of legs 35 could be fixed to the upper wall 3, for example via an end piece and a matching screw to the upper wall 3. The lower parts of legs 35 could be fixed to the upper wall 3 for example by welding to the upper wall 3. To increase the stability of the fixation, the lower parts of legs 35 could have a larger section than the rod 39, for example by adding a support plate substantially perpendicular to the rod 39.

The lower parts of legs 35 could be provided with dilation compensator 36, cf. FIGS. 4, 5 and 8.

As shown on FIG. 8, the dilation compensator 36 could be shaped as a fl, which have its upper part integral with the lower extremity of the rod 39. The dilation compensator 36 is multipode. The dilatation compensator 36 includes, here, at least two lower separate surfaces for support. The lower part of the dilation compensator 36, could be feet shaped. The feet of the dilatation compensator 36 are offset from the rod 39 axis. The feet share contacts on the upper wall 3 around the rod 39 axis. In service, the dilation compensator 36 could have a significant vertical deformation and a proportional horizontal deformation in such a manner to respect the volume conservation. In other words, the bending of dilatation feet compensators 36 make it possible to have height variations of dilatation compensators 36, in service.

The composition and the structure of the support member 30 and of the protection device can be different. Their properties in thermal dilatation, during normal service of the transformer 1, are different. For example a support member 30 including steel and other neighboring elements (cover 9, head 27, etc.) including aluminum or aluminum alloy have different thermal dilatation coefficients. Consequently, the applicant observed that to limit mechanical stresses, it is benefit to admit a vertical displacement of the leg/legs 35 and the plate 31 with the downstream duct 17 in respect to the upper wall 3 of the transformer 1. The displacement is made possible by the malleability of the dilatation compensator 36. The dilation compensator 36 includes metal. The dilatation compensator 36 could include steel wool or steel mesh.

Figure 10:
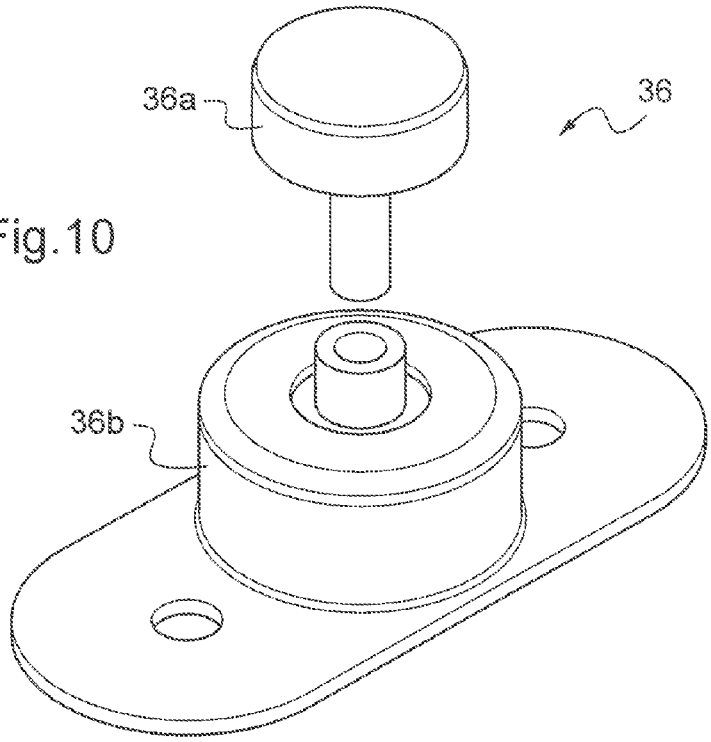
FIG. 10 is a view in perspective of a dilatation compensator.
Figure 11:
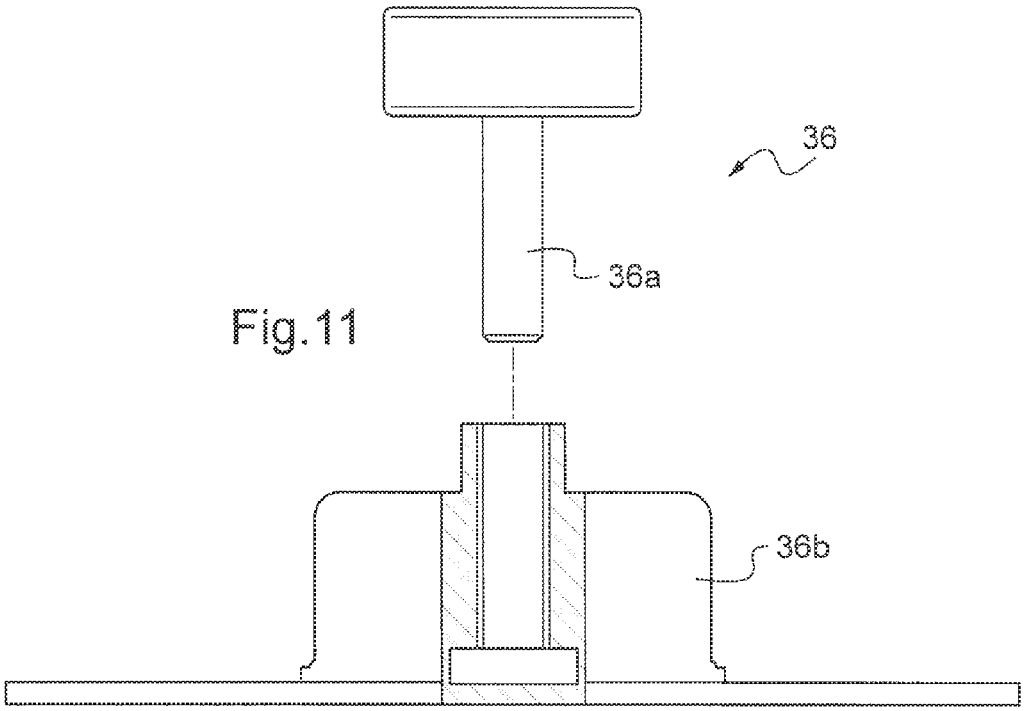
FIG. 11 is a schematic view of a dilatation compensator.

As shown on FIGS. 10 and 11, the dilatation compensator 36 could include an upper part **36*a* and a lower part 36*b*. The rod 39 and the upper part 36*a* are secured together. The upper wall 3 and the lower part 36*b* are secured together. The upper 36*a* and lower 36*b* parts are mutually movable in a vertical axis. The displacement of the upper part 36*a* inside the lower part 36*b* could be slowed by a piston system. For example, the piston system could include a cylindrical portion of the upper part 36*a* sliding in a bore of the lower part 36** adapted.

The dilatation compensator 36 could ensure a vibratory damping.

Figure 7:
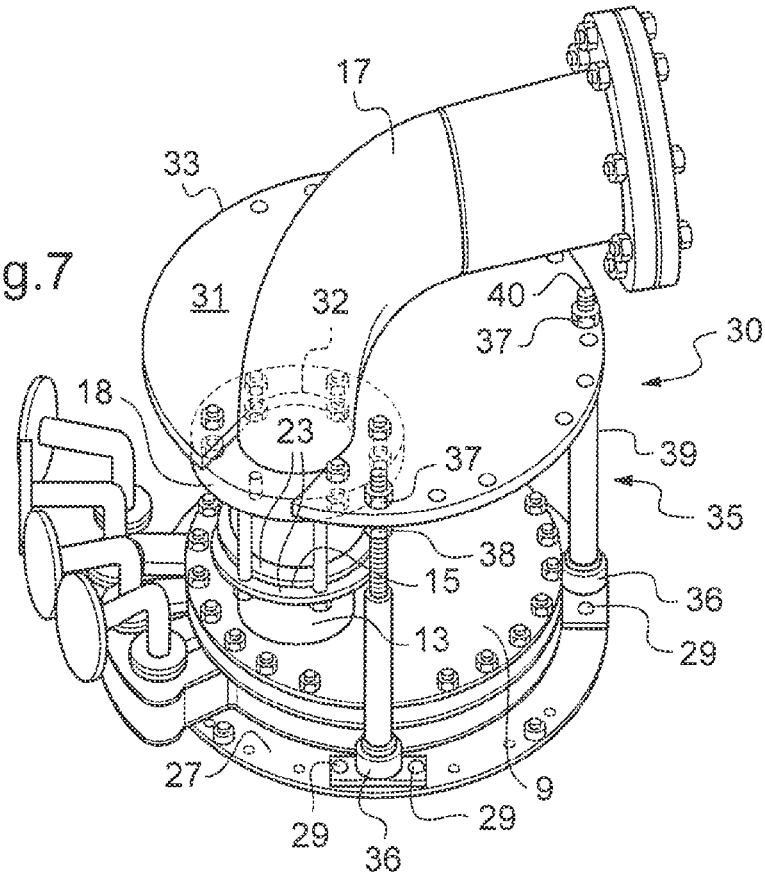
FIG. 7 is a view in perspective of the support member of a prevention device, the on load tap changer being not entirely showed.

As shown on FIG. 7, the nuts 29, using to fix the head 27 with the upper wall 3 could be used to fix the support member 30 on the upper wall 3. The nuts 29 could be used to fix dilatation compensator(s) 36. The support member 30 is distant from the cover 9. The weight of the support member 30 is supported by the upper wall 3 instead of the head 27 or the cover 9.

The isolation valve 25 could be closed in maintenance operation, the electrical transformer 1 being stopped. In normal service of the transformer 1, the isolation valve 25 is open and the rupture element 15 is intact (closed). The flexible sleeves 23 absorb vibrations of the electrical transformer 1 to avoid transmitting vibrations to other elements, especially to the rupture element 15.

In the event of incident in tank 7 of the on load tap changer 5, for example a short circuit, the pressure increases suddenly. If the threshold of pressure predetermined is reached, the rupture element 15, passive, breaks down and opens brutally according to expected operation. The rupture element 15 could be designed to open at a pressure for example between 0.6 and 5 bar. The internal pressure of the on load tap changer 5 is generally higher than inside the main tank 2 of the transformer 1. During the rupture of the rupture element 15, following an electrical default, the internal pressure of the tank 7 of the on load tap changer 5 quickly goes down. The opening lets evacuate a jet of liquid and/or gas quickly through the rupture element 15 open The jet is evacuated via the downstream duct 17. The opening lets evacuate a volume of liquid and/or gases making quickly decrease the internal pressure of the tank 7. The detection of the rupture of the rupture element 15 cause the transformer 1 stopping, for example by triggering of a supply cell of the transformer 1, not shown on figures. The repairs, especially the substitution of the rupture element 15, can begin. The probability to preserve integrity of the tank 7, and the other neighboring elements, is increased.

The detection and safety device is inexpensive, autonomous compared to the neighboring installations, of small volume, independent from the cover of the on load tap changer and requires little or no maintenance.

The assembly of the prevention device against explosion of an on load tap changer requires few modifications of elements of the transformer. In particular, main elements constituting the device are based outside from the cover of the on load tap changer. The cover adaptation to a supplementary weight is avoided. For example, it is not necessary to change an aluminum cover by heavier steel cover. The supporting device makes it possible to benefit of the upper wall of the main tank of the transformer to support a significant part of the weight of the prevention device. The cover of the on load tap changer, existing before a prevention device, could be preserved from every adaptation. The device distant from the cover limits disassembly operations in the event of a maintenance intervention requiring the opening of the cover, for example to work inside the on load tap changer.

The invention makes it possible to install a prevention device against explosion of on load tap changer on existing transformers without altering mechanical integrity of the cover of the on load tap changer. The invention adapts to many existing configurations of transformers using common and standard pieces.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. Device for prevention against explosion of an on load tap changer of an electrical transformer, the on load tap changer comprising a tank and a cover, the tank comprising a dielectric liquid, the prevention device comprising a rupture element provided with tearing zones and with folding zones upon rupture, said rupture element being able to break open when the pressure inside the tank exceeds a predetermined ceiling, at least a support member supporting the rupture element, said support member further supporting a duct downstream the rupture element, the support element being distal from the cover.

2. Device according to claim 1, wherein said support member supports a duct upstream the rupture element and communicating with the tank.

3. Device according to claim 1, wherein a flexible sleeve is mounted between the rupture element and the duct downstream the rupture element.

4. Device according to claim 1, wherein a flexible sleeve is mounted between the rupture element and a duct upstream from the rupture element and communicating with the tank.

5. Device according to claim 1, wherein said support member comprises a plate provided with a notch, the downstream duct being arranged through the notch.

6. Device according to claim 5, wherein said plate has a periphery of a general circular shape.

7. Device according to claim 5, further comprising a strap secured to the plate and maintaining the downstream duct in the notch.

8. Device according to claim 5, wherein the downstream duct comprises a flange for securing to the support member.

9. Device according to claim 1, wherein said support member comprises a plurality of legs and a plate adjustable supported by the legs.

10. Device according to claim 1, wherein the support member comprises a plurality of legs, at least a leg being provided with a dilatation compensator.

11. Device according to claim 9, wherein at least a leg has an adjustable length.

12. Device according to claim 1, wherein said dilatation compensator further performs vibration damping.

13. Device according to claim 1, wherein said dilatation compensator comprises metal.

14. Device according to claim 1, wherein said dilatation compensator comprises steel wool.

15. Device according to claim 1, further comprising an isolation valve arranged upstream the rupture element.

16. Device according to claim 1, wherein the on load tap changer comprises a head supporting the cover and secured to a transformer wall by bolts, at least one of said bolts is further securing the support member and/or a dilatation compensator.

17. Device according to claim 1, wherein the on load tap changer is distinct from a main tank of the transformer.

* * * * *